United States Patent [19]

Bittner

[11] Patent Number: 4,878,878

[45] Date of Patent: Nov. 7, 1989

[54] METHOD AND APPARATUS FOR STABILIZING AND POWERING WALKING ANIMATED FIGURES

[75] Inventor: Ronny E. Bittner, LaVerne, Calif.

[73] Assignee: The Walt Disney Company, Burbank, Calif.

[21] Appl. No.: 17,635

[22] Filed: Feb. 24, 1987

[51] Int. Cl.[4] ..... A63H 33/26; A63H 3/22; A63H 3/20

[52] U.S. Cl. ..... 446/139; 446/134; 446/355; 446/330

[58] Field of Search ..... 446/139, 136, 135, 137, 446/138, 131, 129, 330, 333, 352, 353, 354, 355, 377, 376

[56] References Cited

U.S. PATENT DOCUMENTS

| | | | |
|---|---|---|---|
| 962,069 | 6/1910 | Walters et al. | 446/136 X |
| 2,282,430 | 5/1942 | Smith | 446/136 X |
| 2,493,755 | 1/1950 | Ferrill | 446/129 X |
| 2,996,304 | 8/1961 | Lange | 280/1.181 |
| 3,010,729 | 11/1961 | Tomosy | 280/1.181 |
| 3,093,372 | 6/1963 | Cirami | 272/34 |
| 3,098,319 | 7/1963 | Ellis | 446/136 |
| 3,134,453 | 5/1964 | Cirami | 180/8.6 |
| 3,143,826 | 8/1964 | Ellis | 446/136 |
| 3,237,345 | 3/1966 | Feliziani | 446/130 |
| 3,512,601 | 5/1970 | Wilson | 180/168 |
| 3,540,541 | 11/1970 | Hartley | 180/168 |
| 3,556,244 | 1/1971 | Gray | 180/168 |
| 3,598,196 | 8/1971 | Ballentyne | 180/168 |
| 3,610,363 | 10/1971 | Hartley | 180/168 |
| 3,628,624 | 12/1971 | Wesener | 180/168 |
| 3,638,751 | 2/1972 | Moll et al. | 180/168 |
| 3,653,456 | 4/1972 | Uemura | 180/168 |
| 3,812,929 | 5/1974 | Farque | 180/167 |
| 4,046,262 | 9/1977 | Vykukal et al. | 414/5 |
| 4,088,939 | 5/1978 | Mitschke et al. | 318/516 |
| 4,177,592 | 12/1979 | Ruck | 446/136 X |
| 4,202,423 | 5/1980 | Soto | 180/8.6 |
| 4,258,813 | 3/1981 | Rubel | 180/168 |
| 4,282,677 | 8/1981 | Abe | 446/300 |
| 4,307,891 | 12/1981 | Doornick et al. | 280/1.1 R |
| 4,333,147 | 6/1982 | Regueiro et al. | 369/436 |
| 4,379,497 | 4/1983 | Hainsworth et al. | 180/168 |
| 4,472,716 | 9/1984 | Hansen | 340/905 |
| 4,483,407 | 11/1984 | Iwamoto et al. | 180/9.5 |
| 4,500,970 | 2/1985 | Deammer | 364/513 |
| 4,502,556 | 3/1985 | Bartholet | 180/8.6 |
| 4,503,924 | 3/1985 | Bartholet et al. | 180/8.6 |

FOREIGN PATENT DOCUMENTS

| | | | |
|---|---|---|---|
| 2704673 | 10/1978 | Fed. Rep. of Germany | 446/136 |
| 1072548 | 9/1954 | France | 446/136 |

*Primary Examiner*—Robert A. Hafer
*Assistant Examiner*—D. Neal Muir
*Attorney, Agent, or Firm*—Fulwider, Patton, Rieber, Lee & Utecht

[57] ABSTRACT

A system for stabilizing, powering and controlling walking animatronic figures or vehicles by magnetically attracting and/or repelling the feet of such structures, using various cooperative combinations of interacting ferromagnetic plates and electromagnets to guide and stabilize the structures along a platform, as well as facilitating transformer coupling of AC power and/or command signals from the platform to the walking figure without the need for an umbilical.

2 Claims, 2 Drawing Sheets

FIG. 7
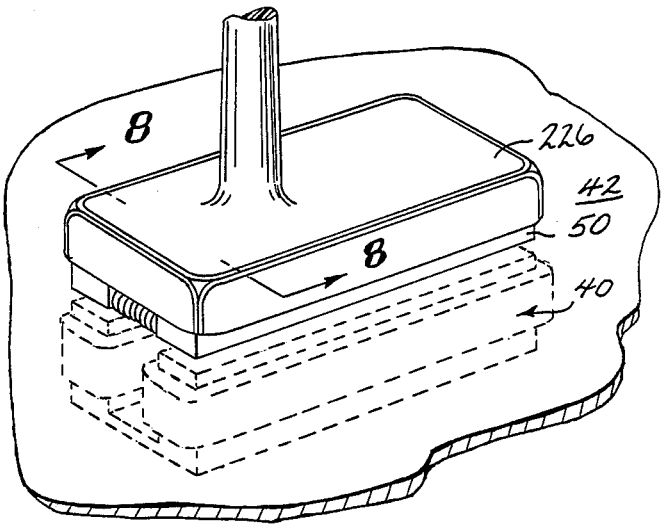
FIG. 8
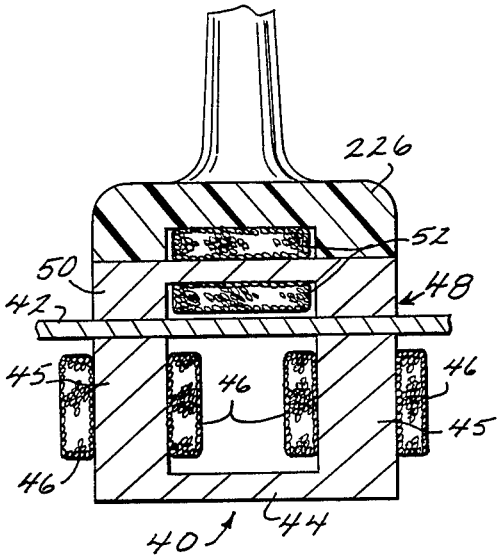
FIG. 9
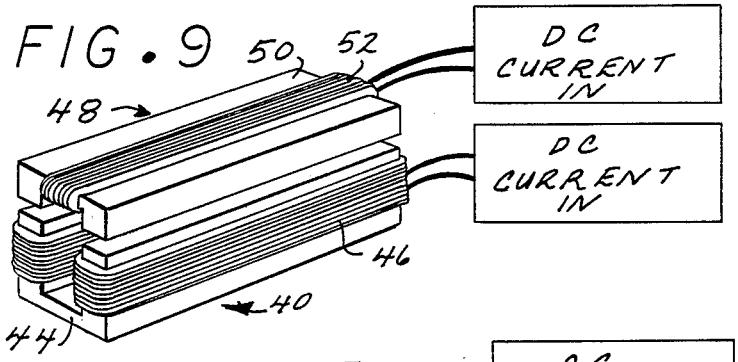
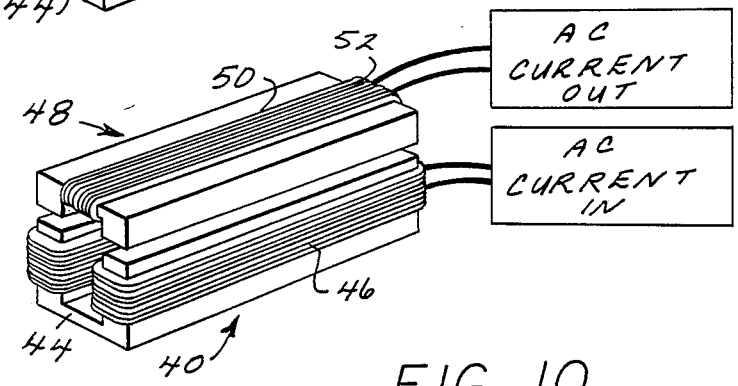
FIG. 10
FIG. 1
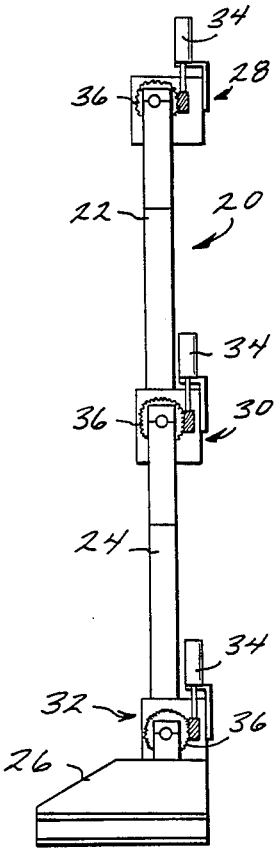

FIG. 2
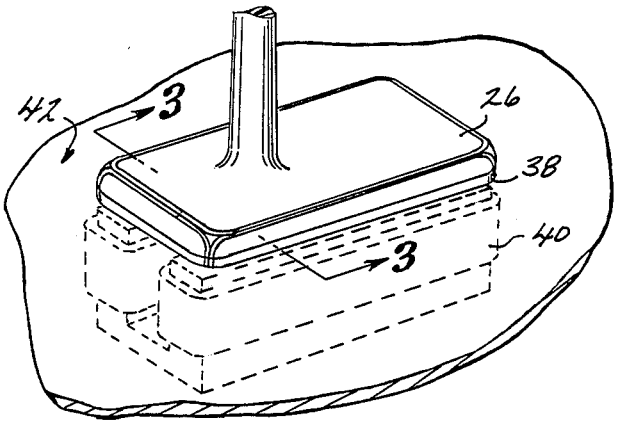
FIG. 3
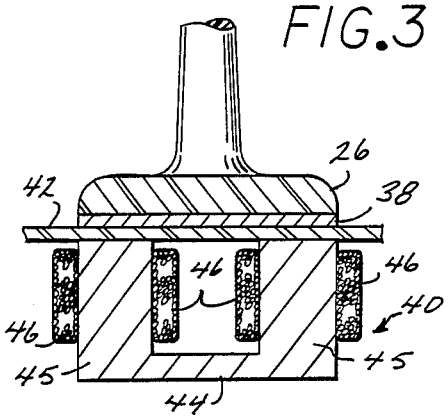
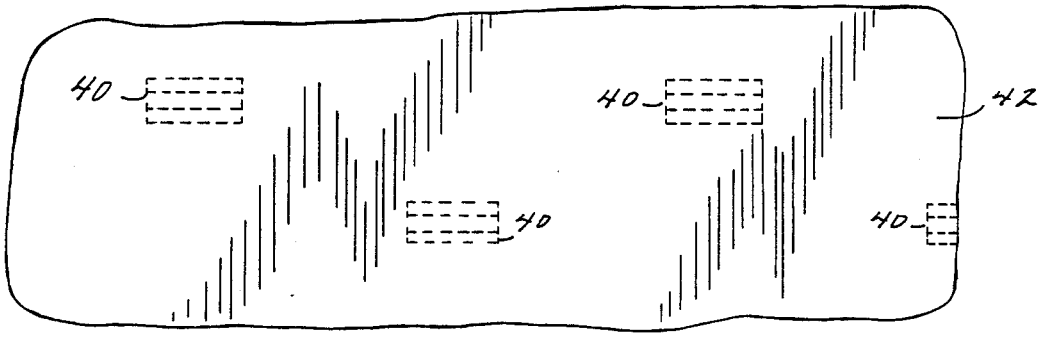
FIG. 4
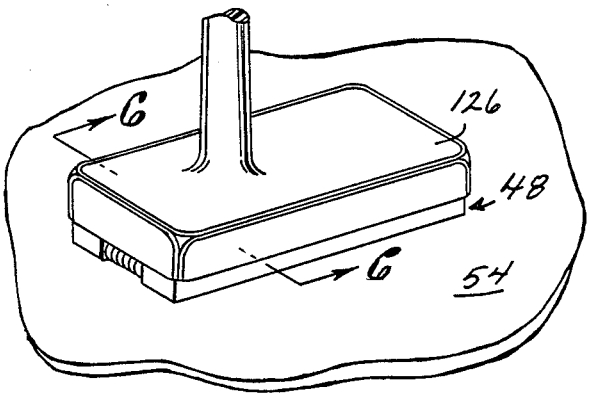
FIG. 5
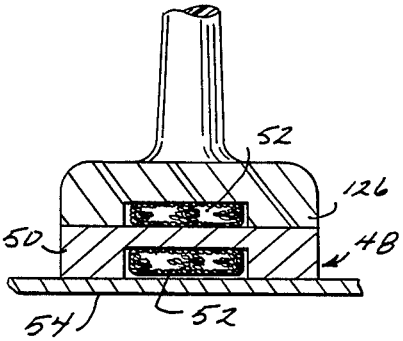
FIG. 6

METHOD AND APPARATUS FOR STABILIZING AND POWERING WALKING ANIMATED FIGURES

BACKGROUND OF THE INVENTION

This invention relates generally to improvements in methods and apparatus for controlling and stabilizing animated figures or vehicles and, more particularly, to a new ad improved walking animatronic figure or vehicle which is magnetically controlled and stabilized and which is capable of receiving electrical power and control signals without the need for a cumbersome umbilical.

Walking animatronic figures or other comparable vehicles, which utilize legs and feet for walking, have problems of stabilization and guidance. For the purposes of illustration, the term "animatronic" is defined as an animated, electronically controlled figure which simulates real-life movement by articulating a pre-programmed repetoir of movements. When one leg is lifted, or when other unbalancing torques are applied to the figure, such as by lifting an object, the figure may become unbalanced. In the past, attempts have been made to stabilize walking animatronic figures by either large feet-like structures, which are disappropriate to normal body features, or by sophisticated gyroscopic balance and control mechanisms.

In addition, animatronic figures and similar vehicles have either required cumbersome and conspicuous umbilical cords to convey electrical power and control signals or have required relatively large and heavy on-board power supplies, radio receivers and the like to perform their designated functions.

Hence, those concerned with the development of walking animatronic figures or comparable vehicles have long recognized the need for improved systems capable of providing stability, electrical power and control signals for such devices in a relatively simple, economical and reliable manner. The present invention fulfills these needs.

SUMMARY OF THE INVENTION

Briefly, and in general terms, the present invention provides a new and improved method and apparatusk for magnetically guiding and stabilizing a walking animated figure or comparable vehicle. In addition, the present invention is capable of electrically powering and controlling such figures or vehicles without an umbilical or on-board power supplies or telemetry devices.

A presently preferred embodiment of the invention, by way of example and not necessarily by way of limitation, involves placing a matrix of electromagnets in a floor or platform and a ferromagnetic plate in the base of each foot of a walking animatronic figure or the like. The electromagnets in the floor or platform are selectively energized electrically to magnetically attract and release each foot of the walking animatronic figure as it advances, thus guiding the walking animatronic figure along the platform. Once an advancing foot has been lowered to the platform, the energized electromagnet securely holds the foot to the platform by magnetic attraction while the opposite foot is being lifted, advanced and lowered, thus stabilizing the walking animatronic figure while the opposite foot is off the platform.

In another embodiment of the invention, an electromagnet is placed in the base of each foot of a walking animatronic figure or the like and a ferromagnetic plate is positioned along a floor or platform. The electromagnet in each advancing foot of the walking animatronic figure is selectively energized to attract the advancing foot to the floor, and once lowered, to securely hold the lowered foot to the platform while the opposite foot is being lifted, advanced and lowered, thus, once again, stabilizing the walking animatronic figure while the opposite foot is off the platform.

In yet another embodiment of the invention, a matrix of electromagnets is placed in a floor or platform and an electromagnet is also placed in the base of each foot of the walking animatronic figure. This embodiment not only allows for the guidance and stabilization of the walking animatronic figure as in the previous embodiments, but also provides a means by which electrical power and/or control signals can be supplied to the walking animatronic figure. Applying AC power to the coils of the electromagnets in the floor, inductively couples AC power into the coils in the feet of the walking animatronic figure. This AC power can be used to energize the electrical motors and electronics of the walking animatronic figure, thus removing the usual requirements for an umbilical to deliver power to the figure. The AC power can also be modulated in order to carry command signals to the walking animatronic figure.

It will be appreciated from the foregoing that the present invention provides a new and improved method and apparatus for stabilizing, powering and controlling a walking animatronic figure or comparable vehicle. Other features and advantages of the present invention will become apparent from the following more detailed description, when taken in conjunction with the accompanying drawings, which illustrate, by way of example, the principles of the invention.

BRIEF DESCRIPTION OF THE DRAWINGS

FIG. 1 is a side elevational view of a walking animatronic figure capable of utilizing the present invention;

FIG. 2 is a partial, perspective view of a presently preferred embodiment of the invention, showing a ferromagnetic plate in the base of a foot of a walking animatronic figure and an electromagnet in a floor or platform below the figure;

FIG. 3 is a sectional view taken substantially along the line 3—3 of FIG. 2;

FIG. 4 is a top plan view of a floor or platform having a matrix of electromagnets at predetermined locations for positioning the animatronic figure;

FIG. 5 is a partial perspective view, similar to FIG. 2, of another embodiment of the invention, showing an electromagnet in the base of a foot of the walking animatronic figure and a ferromagnetic plate positioned in a floor or platform;

FIG. 6 is a sectional view taken substantially along the line 6—6 of FIG. 5;

FIG. 7 is a partial perspective view, similar to FIG. 2, of yet another embodiment of the invention, showing an electromagnet in the base of the foot of a walking animatronic figure and also in a floor or platform;

FIG. 8 is a sectional view taken substantially along the line 8—8 of FIG. 7;

FIG. 9 is a combined block diagram and perspective view of a pair of electromagnets energized by a direct current in accordance with the invention; and FIG. 10 is a combined block diagram and perspective view of a pair of electromagnets energized by an alternating current in accordance with the invention.

DETAILED DESCRIPTION

As shown in the drawings, for purposes of illustration, the invention is embodied in an improved method and apparatus for magnetically stabilizing, powering and controlling a walking animatronic figure 20.

As best observed in FIG. 1, the walking animatronic figure 20 includes a pair of jointed legs 21, each of which includes an upper leg member 22, a lower leg member 24, and a foot 26. The upper end of the upper leg member 22 is rotatably mounted to any suitable hip structure (not shown) at a hip joint 28. The lower end of the upper leg member 22 is rotatably secured to the lower leg member 24 at a knee joint 30. The lower end of the lower leg member 24 is rotatably mounted to the foot 26 at an ankle joint 32. A conventional DC motor 34 or other suitable drive device and appropriate gear boxes 36 drive the hip joint 28, the knee joint 30 and the ankle joint 32 to enable walking by the animatronic figure 20.

In a presently preferred embodiment of the invention, as shown in FIGS. 2 and 3 of the drawings, a ferromagnetic plate 38 is secured to the base of the foot 26. The foot 26 may, of course, take any suitable physical configuration. As shown in FIG. 4, a matrix of electromagnets 40 is placed in a floor or platform 42. Each electromagnet 40 (FIG. 3) includes a U-shaped magnetic core 44 and a pair of coils 46 around the legs 45 of the core.

The coils 46 of the electromagnets 40 are selectively energized to magnetically attract the foot 26 as it advances along the floor 42. Once the advancing foot 26 has been lowered to the floor 42, the energized electromagnet 40 securely holds the foot 26 to the floor by magnetic attraction, while the opposite foot is being lifted, advanced and lowered, thus stabilizing the walking animatronic figure 20 while the opposite foot is off the floor or while any other unbalancing torques are being applied to the walking animatronic figure 20.

The matrix of electromagnets 40 can be placed in the floor or platform 42 in any preselected walking configuration desired for the walking animatronic figure 20 or other comparable vehicle to tranverse.

In another embodiment of the invention, as shown in FIGS. 5 and 6, an electromagnet 48 is installed in the base of the foot 126. The electromagnet 48 includes, by way of example, a U-shaped magnetic core 50 and a coil 52 around the center portion of the U-shaped core. A ferromagnetic plate 54 is positioned along a floor or platform. The coil 52 of the electromagnet 48 in each advancing foot 126 is energized to attract the advancing foot to the ferromagnetic plate 54 and, once lowered, to securely hold the foot 126 to the ferromagnetic plate while the opposite foot (not shown) is being lifted, advanced and lowered. Hence, the walking animatronic figure 20 is stabilized while the opposite foot is off the ferromagnetic plate 54 or while any other unbalancing torques are being applied to the walking figure. Because the electromagnet 48 is placed only in the foot 126, and not in the floor, this embodiment of the invention provides enhanced stability, but does not provide any substantial guidance for the walking animatronic figure 20.

In yet another embodiment of the invention, a matrix of electromagnets 40 is placed in the floor 42, again as shown in FIG. 4. An electromagnet 48 is also placed in the base of a foot 226, as shown in FIGS. 7 and 8. This embodiment not only enables both control and stabilization of the walking animatronic figure 20 as in the previous embodiments, but also provides a means by which electrical power can be supplied to the walking figure.

As shown in FIG. 9, DC current is applied to the coils 46 and 52 of the electromagnets 40 and 48, respectively, in order to energize the electromagnets 40 and 48. However, by also applying AC current to the coil 46 of the electromagnet 40, as shown in FIG. 10, the AC current is inductively coupled into the coil 52 of the electromagnet 48. This AC current coupled into the coil 52 can be inverted into DC current and used to power the DC motor 34 and electronics of the walking animatronic figure 20, thus removing the usual requirements for an umbilical to deliver power to the walking animatronic figure 20. The AC current can also be modulated by conventional techniques well known in the art, in order to carry command signals to the animatronic figure. It will be appreciated that, although AC and DC signals are, for purposes of illustration, shown applied to the same coils in FIGS. 8–10, separate coil windings can be used for the AC and DC signals and other magnetic armature structural configurations may be employed to optimize the performance characteristics of the system.

The new and improved method and apparatus of the present invention magnetically stabilizes, powers and controls animatronic figures and similar vehicles in a simple, economical annd reliable manner which obviates the need for cumbersome and conspicuous umbilicals, oversize foot structures, or on-board power supplies and the like.

It will be apparent from the foregoing that, while particular forms of the invention have been illustrated and described, various modifications can be made without departing from the spirit and scope of the invention. Accordingly, it is not intended that the invention be limited, except as by the appended claims.

I claim:

1. In an animated figure which simulates walking of the type wherein jointed appendages are rotatably mounted to a frame and selectively lifted off a platform surface by the interaction of a plurality of electronically controlled drive motors and gears, an improvement which comprises:

first electromagnetic means secured to a jointed appendage for (1) generating a stabilizing holding force, and (2) inductively receiving an energization signal and command signals; and second electromagnetic means secured to a platform beneath said platform surface and adapted to be energized by a direct current for selectively interacting with said first electromagnetic means for stabilizing said figure by selective magnetic attraction therebetween, said second electromagnetic means being further adapted to be energized by (1) an alternating current, and (2) a modulated current for transmission of said energization and command signals to said first electromagnetic means, said electromagnetic means includes a plurality of electromagnet elements arranged in a matrix, each of said plurality of elements being selectively energized and deenergized for providing said stabilization of said figure and said signals.

2. An improvement as set forth in claim 1, wherein said appendage is formed in the shape of a foot;

said first electromagnetic means is an electromagnet; and said matrix of electromagnet elements of said second electromagnetic means defines a path said figure is intended to traverse.

* * * * *